343-909 SR
2/25/86 XR 4,573,054

United States Patent [19]

Bouko et al.

[11] Patent Number: 4,573,054

[45] Date of Patent: Feb. 25, 1986

[54] EXCITATION DEVICE FOR A DUAL BAND ULTRA-HIGH FREQUENCY CORRUGATED SOURCE OF REVOLUTION

[75] Inventors: Jean Bouko; Jean-Claude Durand; Jean Le Foll; Francois Salvat, all of Paris, France

[73] Assignee: Thomson-CSF, Paris, France

[21] Appl. No.: 488,711

[22] Filed: Apr. 26, 1983

[30] Foreign Application Priority Data

Apr. 27, 1982 [FR] France ..... 82 07254

[51] Int. Cl.[4] ..... H01Q 13/02; H01Q 15/02

[52] U.S. Cl. ..... 343/786; 343/909

[58] Field of Search ..... 343/786, 772, 755, 781 R, 343/729, 779, 909, 756, 776, 753; 333/135, 137, 126, 185

[56] References Cited

U.S. PATENT DOCUMENTS 3,698,001 10/1972 Koyama et al. ..... 343/909
4,258,366 3/1981 Green ..... 343/786

FOREIGN PATENT DOCUMENTS 974843 5/1961 Fed. Rep. of Germany ... 343/781 R
2281660 3/1976 France .
2349968 11/1977 France .
0116869 9/1979 Japan ..... 343/772
0141806 11/1980 Japan ..... 343/786

OTHER PUBLICATIONS

Ohtomo et al., IEEE, MTT-S International Microwave Symposium Digest of Tech. Papers, "A 4,6,20 and 30 GHz Band Branching Network . . . Earth Station", 14-16 Jun., 1976, pp. 52-54.

Ghosh et al., "High Peformance Dual-Band Corrugated Feed . . . Region", IEEE 1981 International Symposium Digest, Ant. and Prop., pp. 69-72.

*Primary Examiner*—Eli Lieberman
*Assistant Examiner*—Michael C. Wimer
*Attorney, Agent, or Firm*—Cushman, Darby & Cushman

[57] ABSTRACT

A device for exciting a corrugated ultra-high frequency source of revolution operating in two remote frequency bands, decoupled mechanically from the source. The device includes two excitation devices corresponding to the two operating bands, placed perpendicularly to each other, at respective distances from the mouth of the source such that the waves which they emit remain canalized in the Rayleigh zone of each device and provide optimum coupling between these device and the source.

16 Claims, 8 Drawing Figures

FIG_3-a
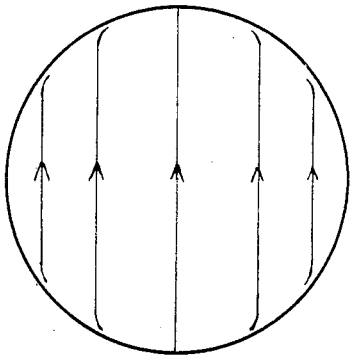
HE11
FIG_3-b
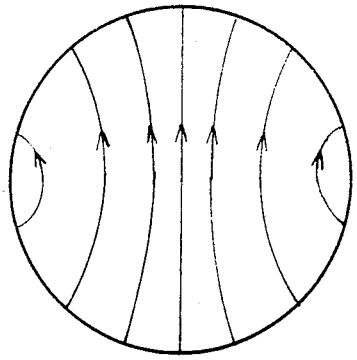
TE11
FIG_4
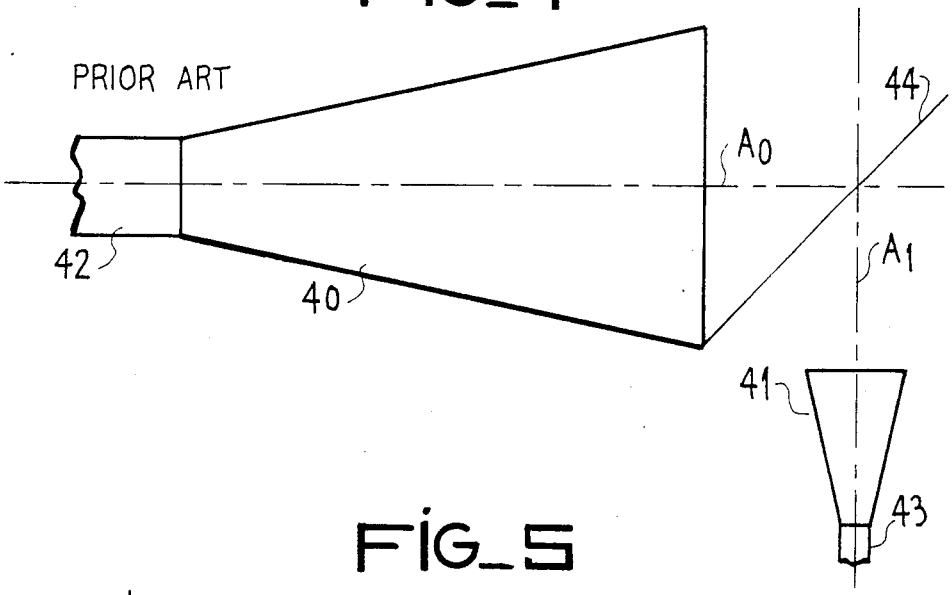
FIG_5
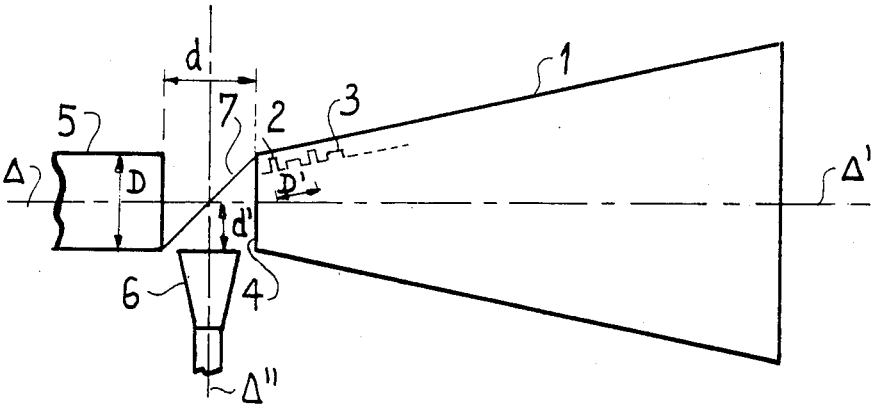

EXCITATION DEVICE FOR A DUAL BAND ULTRA-HIGH FREQUENCY CORRUGATED SOURCE OF REVOLUTION

BACKGROUND OF THE INVENTION

1. Field of the Invention

The present invention relates to an excitation device for an ultra-high frequency corrugated or grooved source of revolution, operating in two remote frequency bands. These remote band corrugated sources, for example X and KU or KA with central frequencies 1, 17 and 35 GHz, are used in a particularly interesting way in dual band radar systems in which the narrow beam of the high band radiation pattern is used for tracking low elevation targets.

2. Description of the Prior Art

After a brief reminder about corrugated sources and the construction and the operation thereof, their presently known excitation devices will be described along with the disadvantages thereof.

By a grooved or corrugated source is meant a waveguide having generally a constant or increasing circular section, which has transverse grooves formed therein the grooves are of a given depth and are spaced apart from one another by a distance $d_O$, also called the period of the corrugated source.

There also exist so-called bi-periodic corrugated sources having two types of alternating grooves.

So as to better understand the operation of a corrugated guide, the notion of mode will be recalled according to which the electromagnetic energy is propagated, that is to say of electric field E and magnetic field H configuration in the guide. It is on this configuration that the radiation of the guide depends. In a guide of revolution with a smooth internal wall, the modes existing are of the well known transverse electric TE or transverse magnetic TM type. In a guide of revolution whose internal wall comprises grooves, the modes which are propagated are of the hybrid type, that is to say they are linear combinations of the two modes TE and TM, of the same phase speed. Before going further into the details, let us first of all be quite clear about the notion of hybrid balance. An operating point of a guide, defined by a frequency f and a propagation constant B, is called a hybrid balance point when, for any cross section of this guide, it presents the following characteristics:

- the electromagnetic field is cancelled out at the inner edges of the corrugated source;
- the field is scalar, described by a real parameter;
- it is of revolution;
- the ratio between the electric field $|\vec{E}|$ and the magnetic field $|\vec{H}|$ is constant at any point of a cross section of the corrugated guide and equal to the impedance of the wave being propagated in the vacuum, (characteristic impedance $\eta$ of the propagation of the wave in free space): $|\vec{E}|=\eta|\vec{H}|$.

For these hybrid balance points, the radiation patterns of the corrugated sources have the same properties, presenting more particularly the advantage of having weak lateral lobes since the electromagnetic field is cancelled out at the edges of the sources and an equality of patterns in the E and H planes. Another very interesting advantage is that there is no cross polarization in the radiation patterns.

Now, these hybrid balance points are very particular operating points of a corrugated guide, the whole of all the operating points forming the dispersion curves of the guide, which curves represent the different hybrid propagation modes. These hybrid modes already defined above comply, so as to exist in a guide, with certain conditions at the limits, i.e. at the level of the internal wall of the guide, more particularly with this one condition: the electric $E\phi$ and magnetic $H\phi$ components situated in a cross section of the guide and perpendicular to the radius thereof, are equal to zero. Now, in a wave guide it is precisely the non zero component $H\phi$ which induces longitudinal currents along the internal wall. This is why, so as to fulfil the condition $H\phi=0$, these currents must be eliminated by placing obstacles in the internal wall of the guide, grooves for example which prevent any current flow.

FIG. 1 is an example of dispersion curves of a simple corrugation source, only comprising a single type of groove. These dispersion curves represent the propagation constant B of the wave which is propagated in the corrugated guide as a function of the propagation constant k of the wave in a vacuum or in free space. Curve $C_1$ represents the hybrid mode $EH_{11}$, curve $C_2$ the hybrid mode $HE_{11}$ which each present a hybrid balance point, referenced respectively $P_1$ and $P_2$. About a hybrid balance point, the operating passband is less than an octave. The periodicity of the curves is $(2\pi/d)$, d being the period of the grooves in the guide.

FIG. 2 shows the dispersion curves of a bi-periodic corrugation source, operating in two different frequency bands, remote from one anothe (X and KU). The alternation of the two series of grooves allow the two modes of the simple corrugated sources to be coupled together. This alternation promotes the appearance of hybrid balances. It can be seen that the dispersion curves $C_3$, $C_4$ and $C_5$ corresponding to the lowest operating band has a period $(2\pi/d')$ about twice as small as that of the dispersion curves $C_1$ and $C_2$ corresponding to the same operating band for a simple corrugated guide, whose repetion period d of the corrugations is twice as small as the d' of the bi-periodic source. New hybrid balance points $P_3$, $P_4$ and $P_5$ appear, on the one hand, in the lowest band, thus resulting in a better stability and, on the other hand, in the highest band ($P_6$ and $P_7$).

The excitation devices known at present for these corrugated sources are formed by a smooth circular guide opening directly into the mouth of these sources. The dimensions of such an excitation guide must be sufficiently small for only the fundamental mode $TE_{11}$ to be propagated, whose electric field lines, in a cross section of the guide, shown in FIG. 3*b*, are the closest to those of the hybrid mode propagating in a corrugated source, the hybrid mode $HE_{11}$ for example shown in FIG. 3*a*. It can be seen that these lines are almost rectilinear and parallel to each other in the center of the guide, but curved towards the edges. This curvature of the field lines shows that the matching between the smooth excitation guide and the corrugated guide is not perfect. To improve this matching, the first grooves of the corrugated guides are given more or less empirically different values from those assigned by the theory of corrugated structures.

For the corrugated sources operating in a single frequency band, this device for exciting by means of a smooth guide only excites the hybrid mode $HE_{11}$, all the other possible modes being evanescent at the nominal frequency.

For corrugated sources operating in two remote frequency bands, several parasite hybrid modes are excited at the same time as the useful hybrid mode. When the two frequency bands are sufficiently close to each other, the ratio between the central frequencies being 1.5 or 1.6, these parasite modes are evanescent in these two bands and do not disturb the normal operation of the source.

But in so far as the sources are concerned operating in remote bands (X and KU or KA), that is to say whose central frequency ratio is greater than or equal to two, several propagative parasite modes may coexist with the desired useful mode and are even generated in the presence of the single fundamental mode $TE_{11}$ in the smooth excitation guide. In fact, the incident mode $TE_{11}$ is broken down into an infinite series of modes in the corrugated source, the first two or three of which modes are propagative in the high band.

In addition to this electrical disadavantage, there is the disadvantage presented by the successive mounting of the two smooth excitation guides, each attributed to one of the two operating bands. On the other hand, when a source is to operate simultaneously in two remote frequency bands with hybrid modes, the construction achieved, shown for example in FIG. 4, is very space-consuming. Such a source is formed from two monoband corrugated sources 40, 41, each excited in accordance with a knon procedure, by a smooth guide for example 42 and 43. Source 40 radiating in the lowest frequency band has larger dimensions than the source 41. They are placed so that their respective propagation axes $A_0$ and $A_1$ are perpendicular. A frequency spatial filter 44 is disposed at the the output of the two sources, at 45° to the two axes $A_0$ and $A_1$. This filter 44 lets the low band wave pass and reflects the high band wave at 90°. Such a dual band source is space consuming and costly.

SUMMARY OF THE INVENTION

The present invention provides a device for exciting an ultra-high frequency corrugated source operating in two remote frequency bands free of the electrical and mechanical disadvantages of the prior art which have just been mentioned.

According to the invention, a device for exciting an ultra-high frequency corrugated source of revolution operating in two remote frequency bands, is characterized in that it is mechanically decoupled from the source.

BRIEF DESCRIPTION OF THE DRAWINGS

The invention will be better understood from the following description, illustrated by the accompanying figures which are, apart from the figures already described relating to the prior art:

FIG. 5: an excitation device according to the invention seen in section through a plane containing the propagation direction of the waves in the corrugated source and a perpendicular plane.

DESCRIPTION OF THE PREFERRED EMBODIMENT

Figure 1:
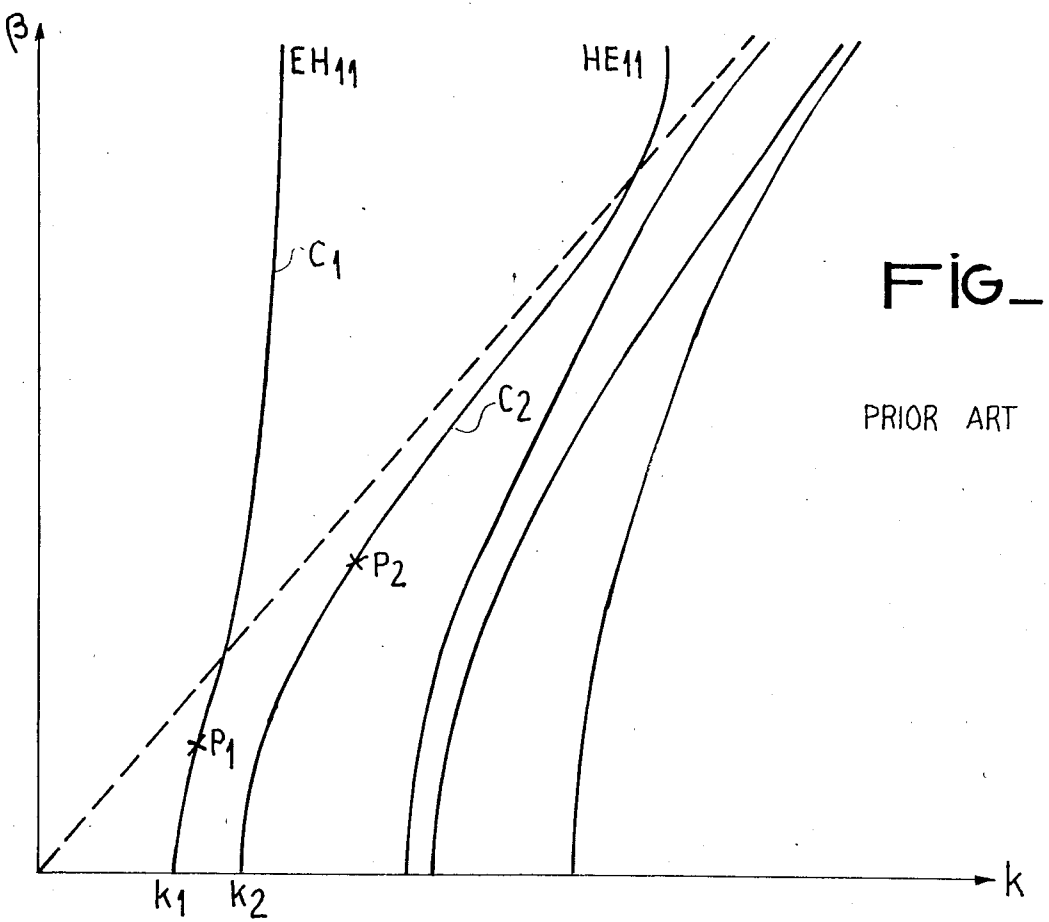
FIG 1 PRIOR ART
Figure 2:
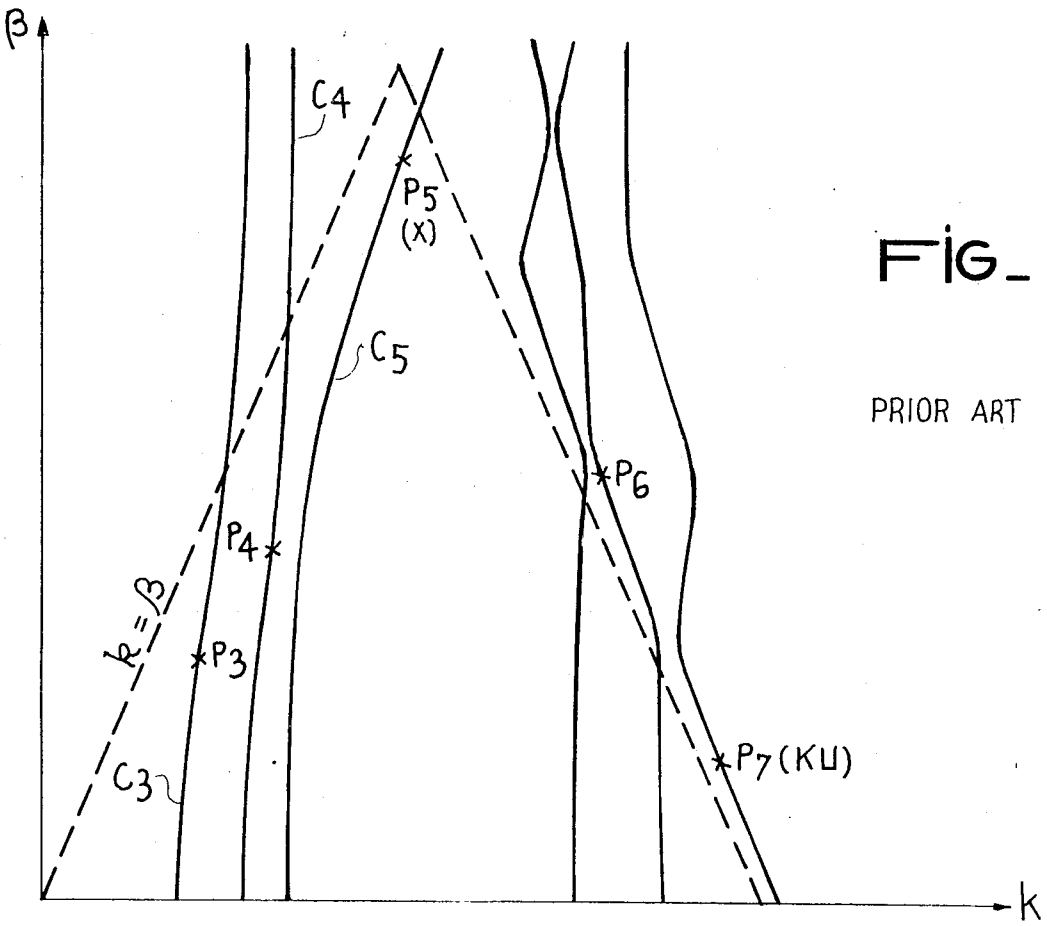
FIG 2 PRIOR ART

The aim of the invention is, from the electrical point of view, to make the electric field, when passing from the excitation device to the corrugated source itself, no longer dependent on the conditions at the limits on the internal wall of the guide—particularly on the orthogonality of the field E—on the internal walls of the guide. As was shown in FIG. 3, which is a section of a smooth guide through a cross section, the field lines are curved on the inner edge of the guide so that, if the excitation device is a smooth guide, the field lines thus generate undesirable parasite modes in the corrugated source. This is why, in accordance with the invention, the dual band corrugated source is excited in free space, that is to say by means mechanically decoupled from said source. By this mechanical decoupling between the excitation device and the corrugated source, this latter is excited by near zone radiation, called the Rayleigh zone, for which the energy emitted by the excitation device remains canalized without dispersion effect. If the excitation device is a circular guide of diameter D and if the operating wavelength is $\lambda$, the Rayleigh zone, defined at the output of the guide along the propagation axis thereof, has a limit length equal to $D^2/2\lambda$.

FIG. 5 shows one embodiment of the invention, seen in longitudinal section. The ultra-high frequency corrugated source 1 operating in two frequency bands is formed by a corrugated horn of revolution excited by two means mechanically decoupled from said source and having respective perpendicular propagation axes $\Delta$ and $\alpha'$. Horn 1 comprises two series of alternating grooves 2 and 3 in its internal wall. These grooves are repeated according to a period D'.

The means for low band excitation of the corrugated source 1 is formed by a smooth guide 5 of circular cross section placed at a distance d from the mouth 4 of the source 1, less than the limit of the Rayleigh zone of the guide. The propagation axis of this guide merges with that $\Delta'$ of the corrugated guide 1. This guide radiates in mode $TE_{11}$, for example, in which the configuration of the electromagnetic field is the closest to that of the useful low band hybrid mode.

The high band excitation means is, in the case shown, a corrugated horn 6, radiating in a mode close to the high band hybrid mode. It is placed so that its propagation axis $\Delta''$ is perpendicular to the axis of guide 5, at a distance d' therefrom, where d' is less than the limit of the Rayleigh zone of the horn 6.

So as to be able to be excited by these two means successively or simultaneously, a spatial frequency filter 7 is placed between them and the corrugated source 1, at 45° to the axes $\Delta$ and $\Delta'$. Thus, the low band wave passes through this filter 7 to excite the mouth 4 of the dual band source 1 and the high band wave undergoes a reflection of 90° at this filter to excite source 1 in its turn. This spatial frequency filter allows at least two beams of different frequencies coming from two separate sources to be re-united in a single electromagnetic wave beam.

But FIG. 5 is only one non limiting example of implementation of the invention. In fact, the two excitation means may be smooth guides, or corrugated guides, and have a right-angled or rectangular section. Similarly, the low band excitation means is not necessarily in the axis of the mouth of the corrugated source and may be perpendicular thereto. If this means is more readily placed in the axis of the source, it is for reasons of space, since it generally has larger dimensions than the high band excitation means. Thus, a smaller spatial filter may be used. This spatial filter 7 which separates the electromagnetic waves of a given mean incidence angle situated in different frequency bands, may be a multi-layer dielectric or a simple polarizing network with parallel wires if the excitation means emit waves with orthogonal rectilinear polarizations. Other more elaborate arrangements, more especially periscopic, may be envisaged when the corrugated source itself is to effect a rotation.

However, in all the embodiments of the invention, the distances d and d', at the output of the means for exciting the corrugated source, are chosen so as to obtain optimum coupling between the excitation means and the corrugated source, that is to say so that the energy emitted by the two excitation means is transmitted as completely as possible to the mouth of the corrugated source. The passband of such a biperiodic source is an octave, as for a simple corrugated source.

The advantages of the invention are the following. First of all from the electrical point of view, the problems of exponential transition between a smooth excitation guide and a corrugated guide are removed since it is no longer necessary to adjust the first grooves, the exciting field lines entering the corrugated guide under the best geometric configuration and coupling conditions. In addition, since there is no longer any problem of transition between guides, guides with a rectangular cross section may advantageously be used, inside which is propagated their fundamental mode $TE_{10}$, whose rectilinear field lines are well suited to the excitation of a corrugated source, thus providing a distinct improvement. Then, from a mechanical point of view, the invention allows a simplification of construction since the contour of the excitation guide is independent of that of the mouth of the corrugated source. For an even better matching, rectangular guides may be used having a bell-mouthed opening thus becoming sectoral horns. In this case, the wave impedance corresponds better to that of the corrugated guide and correlatively the Rayleigh zone is broadened thereby, thus allowing better use of the principle. For the high band, it may even be advantageous to use an exciting corrugated horn, itself fed by the conventional device, so as to better eliminate the parasite modes.

From the space-saving point of view, it can be seen from FIGS. 4 and 5, which are to the same scale, that the dual band source of the invention takes up less space than the dual band source of the prior art, since this source of the invention has approximately the same dimensions as the low band source of the prior art.

Figure 6:
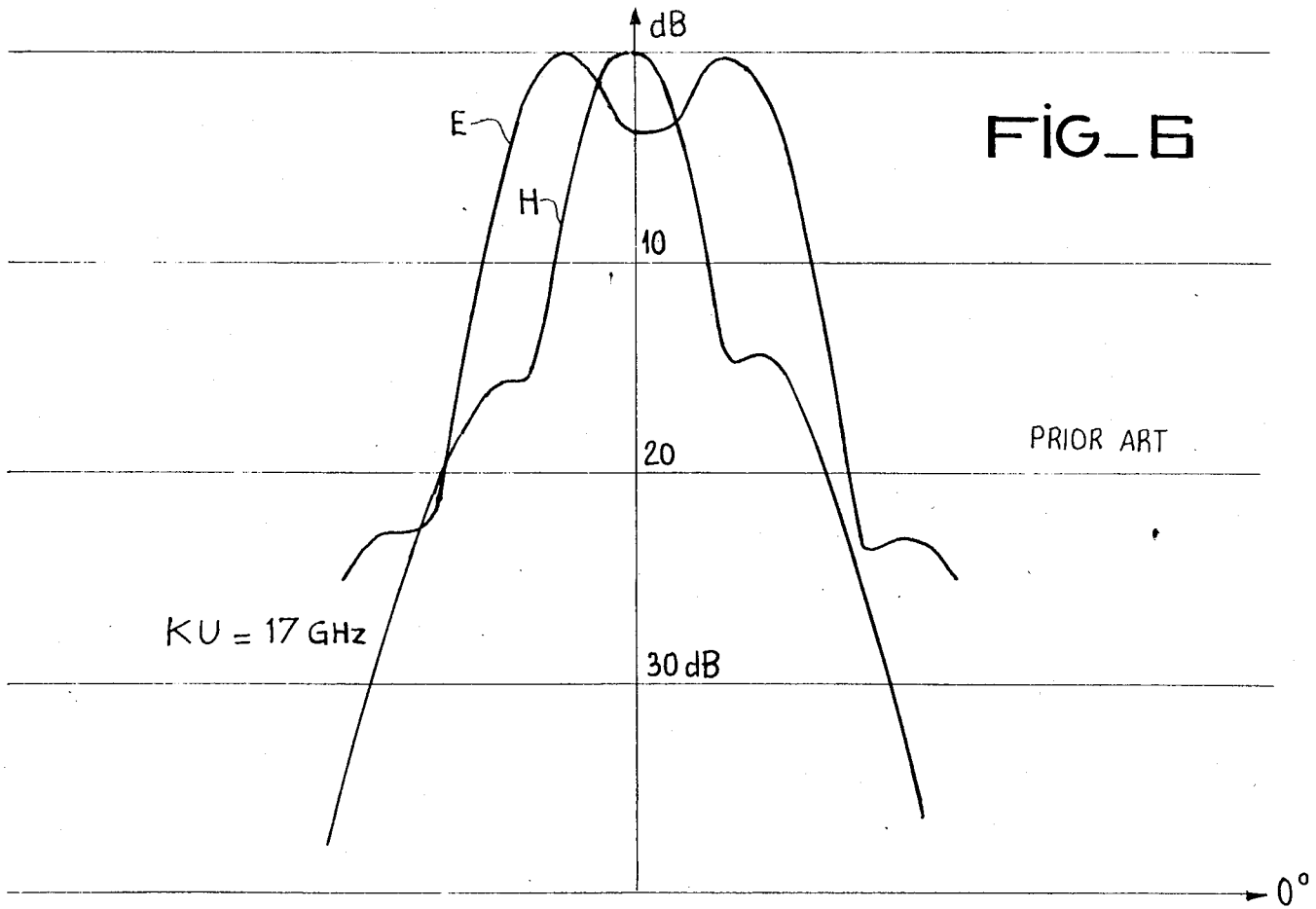
FIGS. 6 and 7: radiation patterns of dual band corrugated sources, respectively according to the prior art and according to the invention.
Figure 7:
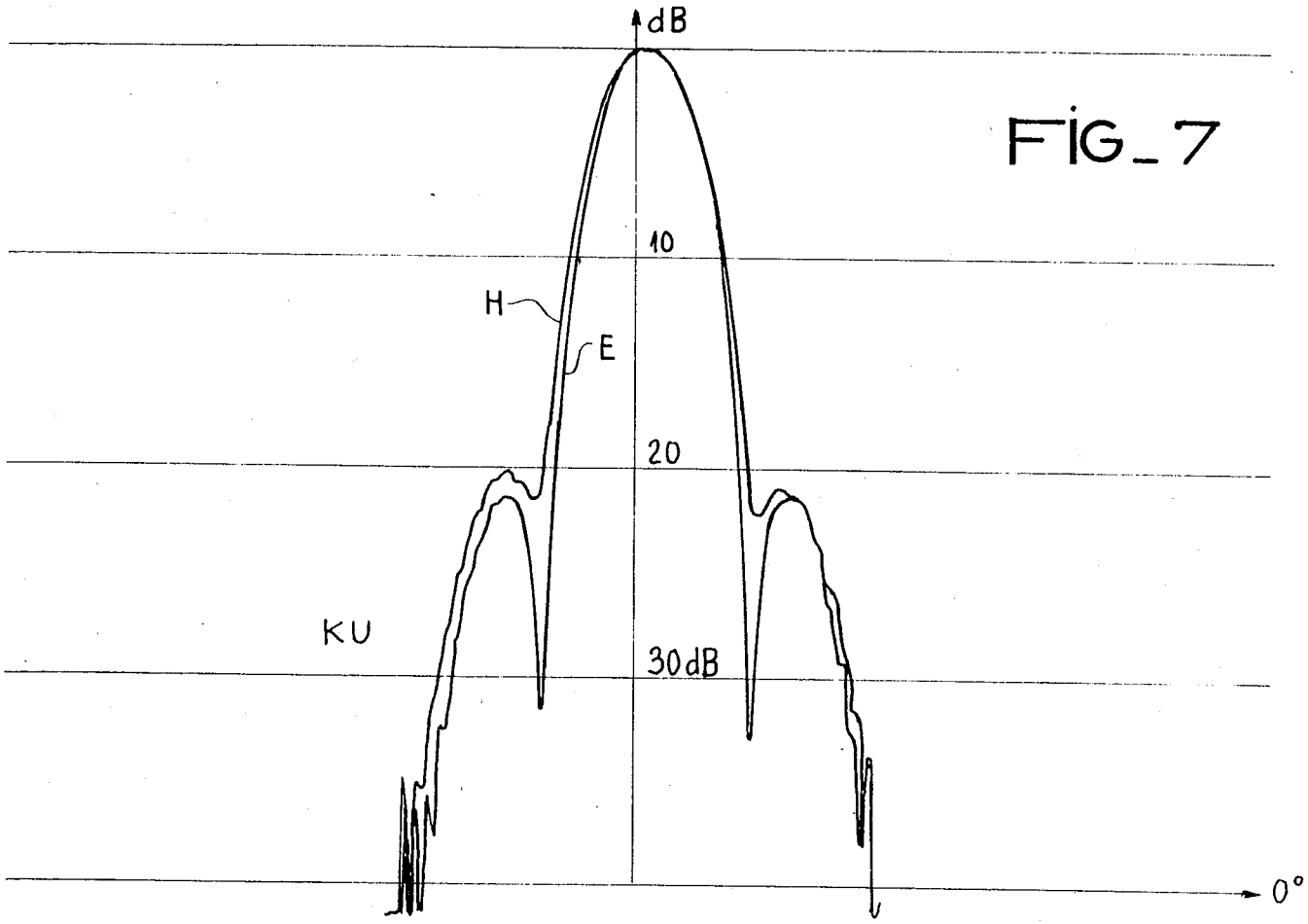

In so far as the radiation patterns are concerned, FIGS. 6 and 7 bear witness to the appreciable improvement provided by the excitation device of the invention.

The patterns of these two figures relate to a corrugated remote band source (X and KU) formed by a guide with alternating grooves of diameter 52.5 mm (2.9 in KU). The excitation device is a smooth circular section guide having the same section as the corrugated guide, comprising plates on its inner wall to rectify the field lines thereof. In FIG. 6, the poor quality of the electric and magnetic patterns can be seen when the excitation guide—smooth guide—is coupled to the corrugated source of the prior art. Parasite modes combine with the useful mode and cause great disproportions between planes E and H.

FIG. 7 relates to excitation in free space, according to the invention, the smooth guide being spaced from the corrugated source by 62 mm. The patterns shown are practically identical with the theoretical ones of the useful hybrid mode, the divergences being explained by the residual presence of parasite modes which excitation by a rectangular section guide would easily eliminate.

While the invention has been described in connection with what is presently considered to be the most practical and preferred embodiments, it is understood that the invention is not to be limited to the disclosed embodiment but, on the contrary, is intended to cover various modifications and equivalent arrangements included within the spirit and scope of the appended claims which scope is to be accorded the broadest interpretation so as to encompass all such modifications and equivalent structures.

We claim:

1. Excitation apparatus, comprising:

a main corrugated radiator;

means for providing low frequency excitation to said radiator;

means for providing high frequency excitation to said radiator; and a spatial frequency filtering device disposed between said radiator and said low and said high frequency means, whereby said low and said high frequency means are physically decoupled from said radiator but are spaced from said radiator in such a way that hybrid balance is propagated in said radiator.

2. Apparatus according to claim 1, wherein said low and said high frequency means each have a Rayleigh zone, and wherein said radiator has a mouth which is disposed within the Rayleigh zone of both low and high frequency means and which receives said excitation from said means.

3. Apparatus according to claim 2 wherein the Rayleigh zone of each said low and said high frequency means equals $D^2/2\lambda$, where D is equal to a diameter of said means and $\lambda$ is equal to an operating wavelength of said means, respectively.

4. Apparatus according to claim 1 wherein said low frequency means has a propagation axis $\Delta$, said high frequency means has a propagation axis $\Delta''$ which is substantially perpendicular to said axis $\Delta$, said radiator has a propagation axis $\Delta'$ which is substantially parallel to said axis $\Delta$, and said spatial frequency filtering device is disposed at approximately a 45° angle from said axes $\Delta$ and $\Delta''$.

5. Apparatus according to claim 4 wherein said spatial frequency filtering device passes said low frequency radiation but reflects said high frequency radiation by approximately 90° so that both low and high frequency radiation enter said radiator along axis $\Delta'$.

6. Apparatus according to claim 1 wherein said low and said high frequency means each include a waveguide.

7. Apparatus according to claim 6 wherein each said waveguide has an internal wall which is smooth.

8. Apparatus according to claim 6 wherein each said waveguide has an internal wall which is corrugated.

9. Apparatus according to claim 6 wherein each said waveguide has a rectangular cross section.

10. Apparatus according to claim 7 wherein each said waveguide has a circular cross section.

11. Apparatus according to claim 1 wherein said low and said high frequency means each include a horn.

12. Apparatus according to claim 11 wherein each said horn has an internal wall which is smooth.

13. Apparatus according to claim 11 wherein each said horn has an internal wall which is corrugated.

14. Apparatus according to claim 11 wherein each said horn has a rectangular cross section.

15. Apparatus according to claim 11 wherein each said horn has a circular cross section.

16. Apparatus according to claim 1 wherein said low frequency means includes a waveguide, and said high frequency means includes a horn.

* * * * *